US007435106B2

(12) United States Patent
Su et al.

(10) Patent No.: US 7,435,106 B2
(45) Date of Patent: Oct. 14, 2008

(54) CABLE CONNECTOR ASSEMBLY WITH INTERNAL PRINTED CIRCUIT BOARD

(75) Inventors: Ping-Sheng Su, Tu-cheng (TW); Zhi-Gang Cai, Kunshan (CN); Xue-Chao Wang, Kunshan (CN); Wei Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/714,444

(22) Filed: Mar. 6, 2007

(65) Prior Publication Data

US 2007/0207655 A1 Sep. 6, 2007

(51) Int. Cl.
*H01R 12/00* (2006.01)
*H05K 1/00* (2006.01)

(52) U.S. Cl. ..... 439/76.1

(58) Field of Classification Search ..... 439/76.1, 439/660, 610

See application file for complete search history.

(56) References Cited

U.S. PATENT DOCUMENTS

| | | | | |
|---|---|---|---|---|
| 5,906,512 | A | 5/1999 | Reynolds | |
| 6,083,041 | A | 7/2000 | Kuo | |
| 6,166,892 | A | 12/2000 | Wu | |
| 6,364,707 | B1 | 4/2002 | Wang | |
| 6,948,949 | B1 * | 9/2005 | Schwartz et al. | 439/76.1 |

* cited by examiner

*Primary Examiner*—Javaid Nasri
(74) *Attorney, Agent, or Firm*—Wei Te Chung

(57) ABSTRACT

A cable connector assembly (100) includes a frame (2) defining a opening (20) for attaching the cable connector assembly with a panel of the mating connector, a printed circuit board (3) assembled with the frame with a number of passageways (30), a connector (1) attached with the frame, having a number of terminals (10) assembled therein, and extending through the passageways, and a cable (4) with a number of conductors (40, 41) electrically attaching with corresponding terminals though the passageways.

12 Claims, 4 Drawing Sheets

CABLE CONNECTOR ASSEMBLY WITH INTERNAL PRINTED CIRCUIT BOARD

This application claims priority to prior Chinese patent application 200610038737.8, the disclosure of which is incorporated herein by reference.

BACKGROUND OF THE INVENTION

1. Field of the Invention

The present invention relates to a cable connector assembly, and more particularly to a cable connector assembly which can ensure reliable grounding and electromagnetic interference (EMI) shielding.

2. Description of Related Art

A cable connector assembly, such as an Universal Serial Bus (USB) connector, transmits electrical signals, including data signals and power signals, between electrical parts and other devices. With the improvement of transmission speed, a basic command to the cable connector assembly is to protect the signal transmission from being influenced from EMI. In addition, for attaching the cable connector assembly to a panel of an electronic device conveniently, such as a Personal Computer, a metal frame is generally employed.

A conventional USB connector is disclosed in U.S. Pat. No. 6,083,041 for achieving above goals. Referring to FIG. 1 in conjunction with FIG. 5, the USB connector includes a connector device 2 with a plurality of contacts arranged therein, a housing 1 with a cavity 11 for receiving the connector device 2 therein, and a metal panel 3 with two pairs of latching members 31 extending therefrom for latching with the housing 1. In order to prevent the USB connector from EMI, tip ends 33 of the latch members 31 are curved to contact the shield 22 of the connector device 2, thereby establishing grounding paths between the connector device 2 and the panel 3 to reduce EMI influence.

Whether a mechanical and electrical connection between the panel 3 and the housing 2 is reliable only depends on reliable degree of tip ends 33 of the latching member 31 abutting against inner surfaces of connecting holes 14 of the housing 1. However, such engagement is not enough to suffer from exterior needless affection. In a vibrative circumstance, the latching member 31 may loose from the housing 1, thereby causing an interruption of grounding paths between the connector device 2 and the panel 3 and further influencing signal transmission between the USB connector and complementary electronic device.

Hence, an improved cable connector assembly is desired to address the problems stated above.

SUMMARY OF THE INVENTION

An object of the present invention is to provide a cable connector assembly which has a locking member for directly assembling an electrical connector to an electronic device such as a Personal Computer.

Another object of the present invention is to provide a cable connector assembly having an improved printed circuit board providing the cable connector assembly with good grounding performance.

To achieve the above objects, a cable connector assembly in accordance with the present invention comprises a connector, having a plurality of terminals assembled therein, a frame attached with the connector, a printed circuit board assembled with the frame and electrically connecting with the terminals, a cable with a plurality of conductor electrically attaching with the printed circuit board.

Other objects, advantages and novel features of the invention will become more apparent from the following detailed description when taken in conjunction with the accompanying drawings.

DETAILED DESCRIPTION OF THE INVENTION

Figure 1:
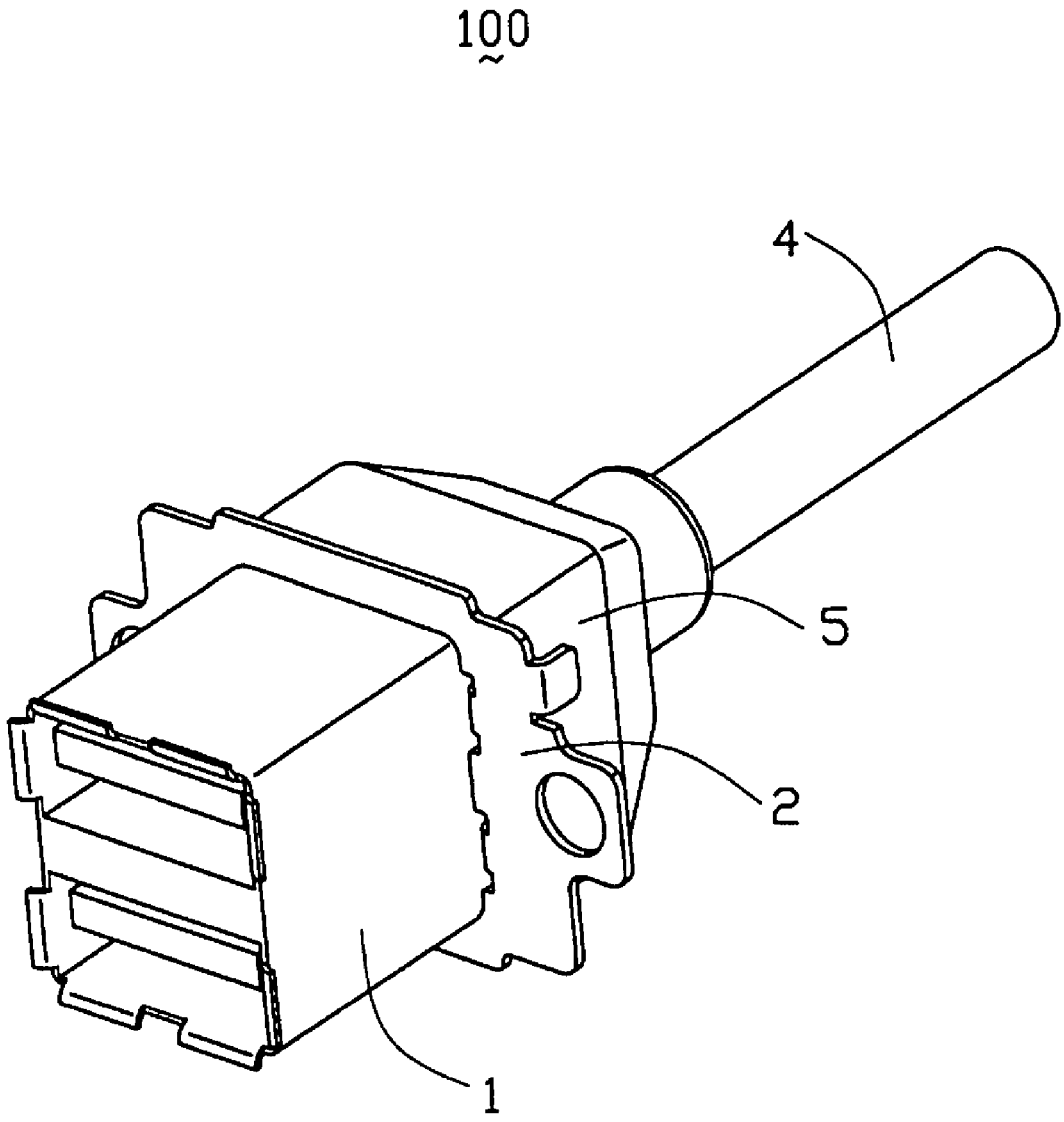
FIG. 1 is an assembled, perspective view of a cable connector assembly in accordance with the present invention.
Figure 2:
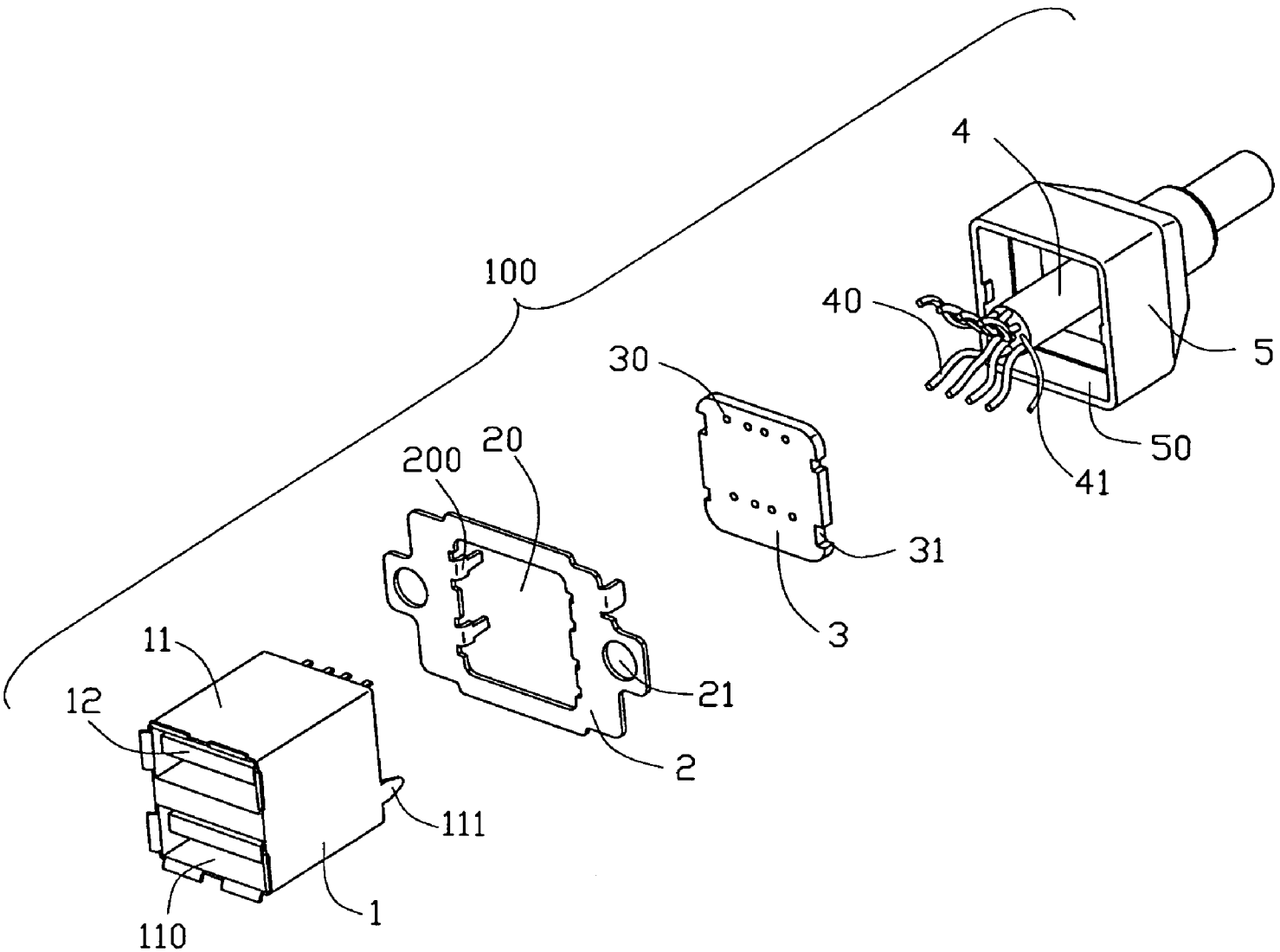
FIGS. 2-3 are exploded, perspective views of FIG. 1, and viewed from different aspects.
Figure 3:
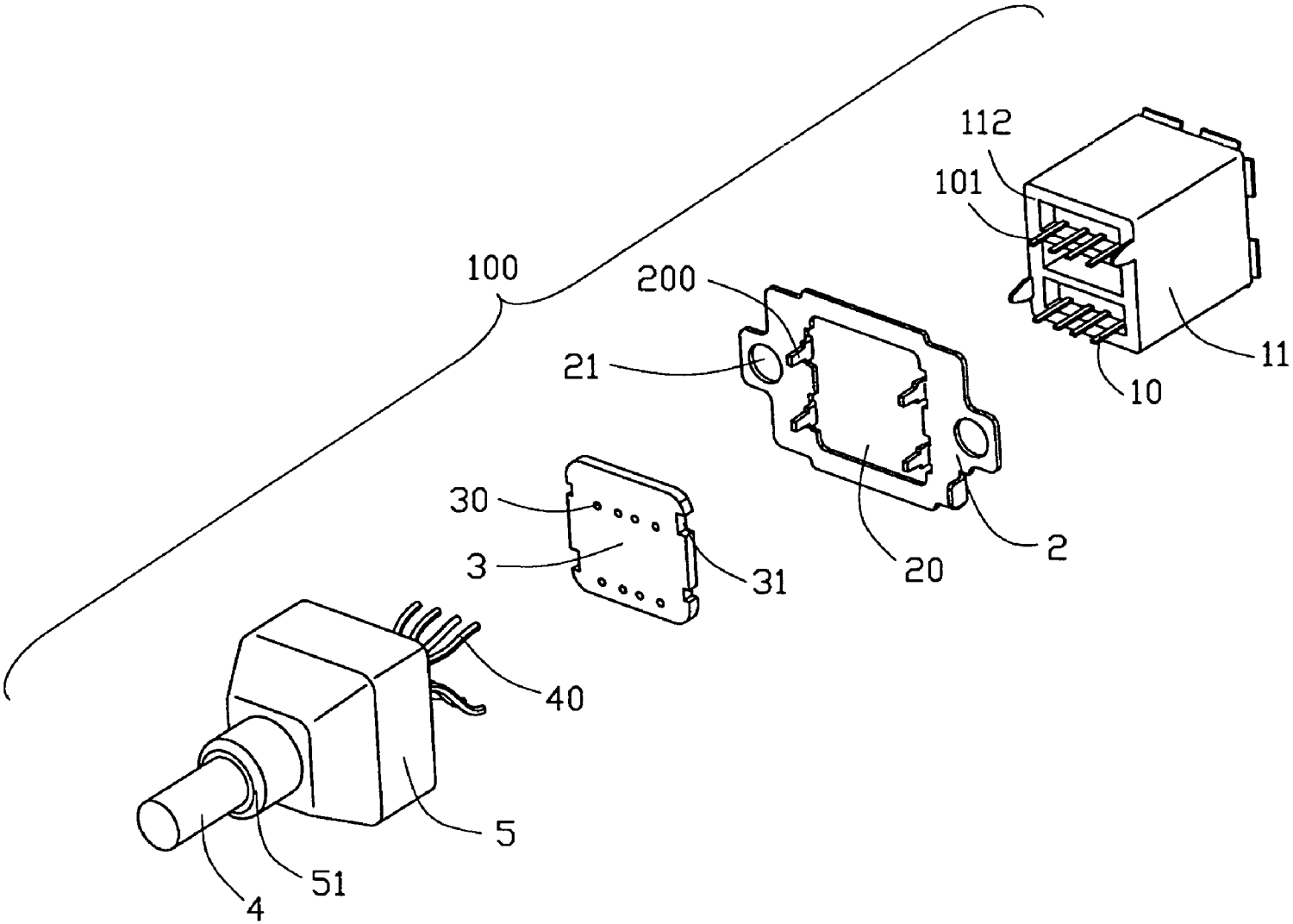

Referring to FIGS. 1 to 3, a cable connector assembly 100 in accordance with the present invention comprises a connector 1 having a plurality of terminals 10 received therein, a frame 2 assembled with the connector 1, a printed circuit board 3 assembled with the connector 1 and the frame 2, with a plurality of passageways 30 formed thereon for allowing the terminals 10 extending through, a cable 4 defining a plurality of signal conductor 40 electrically connecting to corresponding terminals 10 and a single grounding conductor 41, and a cover 5 assembled with the frame 2 for receiving the printed circuit board 3.

Referring to FIGS. 2-3, the connector 1 comprises a metal shell 11 defining a pair of receiving cavities 110 stacked side by side along a vertical direction and a pair of fingers 111 with tapered shape respectively extending from two lateral sides thereof and beyond a rear surface 112 thereof, an insulative housing (not labeled) with a pair of tongues 12 respectively received in corresponding receiving cavities 110, and the terminals 10 extending in a first direction and having a plurality of mating ends (not shown) received in the insulative housing and adopted to electrically engage with a mating connector (not shown) and a plurality of tail ends 101 extending beyond the rear surface 112 of the metal shell 11. In this embodiment, the connector 1 is a stacked USB type.

Referring to FIGS. 2-3, the frame 2 is stamped and formed from a metallic plate or other conductive material, and defines a substantially rectangular opening 20 for providing the connector 1 protruding therethrough, two pairs of locking fingers 200 formed on two lateral inner edges of the opening 20 and bent rearwardly, and a pair of circular holes 21 respectively formed on a pair of flanges thereof (not labeled) for allowing a pair of screws (not shown) extending through and attaching the cable connector assembly 100 to the mating connector. Noticeably, two diagonal locking fingers 200 are arranged corresponding to the fingers 111 of the metal shell 11 respectively, and each locking finger 200 is formed with a relative large dimension in a front portion along the vertical direction and a relative small dimension in a rear portion thereof.

Referring to FIGS. 2-3, the printed circuit board 3 comprises two rows of passageways 30 defined therein for allowing the tail ends 101 of the terminals 10 extending therethrough, and two pairs of C-shape holes 31 corresponding to the locking fingers 200 of the frame 2 for allowing the locking fingers 200 and the fingers 111 of the metal shell 11 posited therein.

Referring to FIGS. 2-3, the cable 4 comprises a plurality of signal conductors 40 electrically connecting with corresponding tail ends 101 of the terminals 10, usually, by means of soldering the signal conductors 40 to the tail ends 101, and a single grounding conductor 41 for electrically soldered to one of the locking fingers 200 of the frame 2 and the fingers 111 of the metal shell 11, thereby establishing a grounding path therebetween.

Referring to FIGS. 2-3, the cover 5 comprises a receiving space 50 for allowing the printed circuit board 3 received therein, and a cable channel 51 for allowing the cable 4 extending through.

Referring to FIGS. 1-4, in an assembly of the cable connector assembly 100, first, the frame 2 is pulled to attach with the connector 1. Because a size of the opening 20 of the frame 2 is slightly larger than that of the connector 1, the frame 2 can receive a rear end of the connector 1 and be posited adjacent to the rear surface 112 of the metal shell 11. Noticeably, the pair of fingers 111 of the metal shell 11 is overlapped with corresponding diagonally locking fingers 200 of the frame 2, and the fingers 111 of the metal shell 11 is located inside comparing with the locking fingers 200.

Then, attaching the printed circuit board 3 to above assembly in the first direction. The printed circuit board 3 will abut against the rear surface of the frame 2. The tail ends 101 of the terminals 10 protrude through corresponding passageways 30 of the printed circuit board 3, the locking fingers 200 and the fingers 111 are simultaneously inserted through the C-shape holes 31. Noticeably, the terminals 10 are respectively arranged perpendicular to the printed circuit board 3.

Next attaching the cable 4 with the tail ends 101 of the terminals 10 which are received within the passageways 30. For preventing the cable 4 loosing from the terminals 10, we adopt the melted plastic material or other adhesive material or some conductive materials to solder them within the passageways 30 so as to enhance the electrical connection therebetween. Similarly, the pair of looking fingers 200 of the frame 2 which do not overlapped with the fingers 111 of the metal shell 11 is posited in and soldered with the C-shape holes 31 solely, the pair of looking fingers 200 of the frame 2 which are arranged side by side with the fingers 111 of the metal shell 11 is posited in and soldered with the C-shape holes 31 with the locking fingers 200 integrally. The single grounding conductor 41 is soldered with one of the looking fingers 200 and the fingers 111 selectively. Because the metal shell 11, the frame 2 and the grounding conductor 41 are formed by a conductive material and electrically connect with one another, a grounding path is established therebetween for transmitting excessive charge and preventing the cable connector assembly 100 from EMI.

Referring to FIGS. 1-4, last, attaching the cover 5 with the flame 2 with the cable 4 extending through the receiving space 50 and the cable channel 51. Before an assembly process, we provide adhesive material on either the cover 5 or flame 2 for attaching the cover 5 to the frame 2 reliably. Obviously, we also can provide adhesive material after an assembly process. As a result, the cover 5 together with the frame 2 encloses the printed circuit board 3 therein, and restrictedly limits the movement of the frame 2. For achieving a reliable connection, the adhesive material also can be provided between the printed circuit board 3 and the cover 5. In addition, a person with ordinary skill in this art can adopt interengaging means, such as a locking barb formed on the frame 2, a corresponding hole for allowing the locking barb to lock formed on the cover 5 for attaching the cover 5 with the frame 2 reliably.

Figure 4:
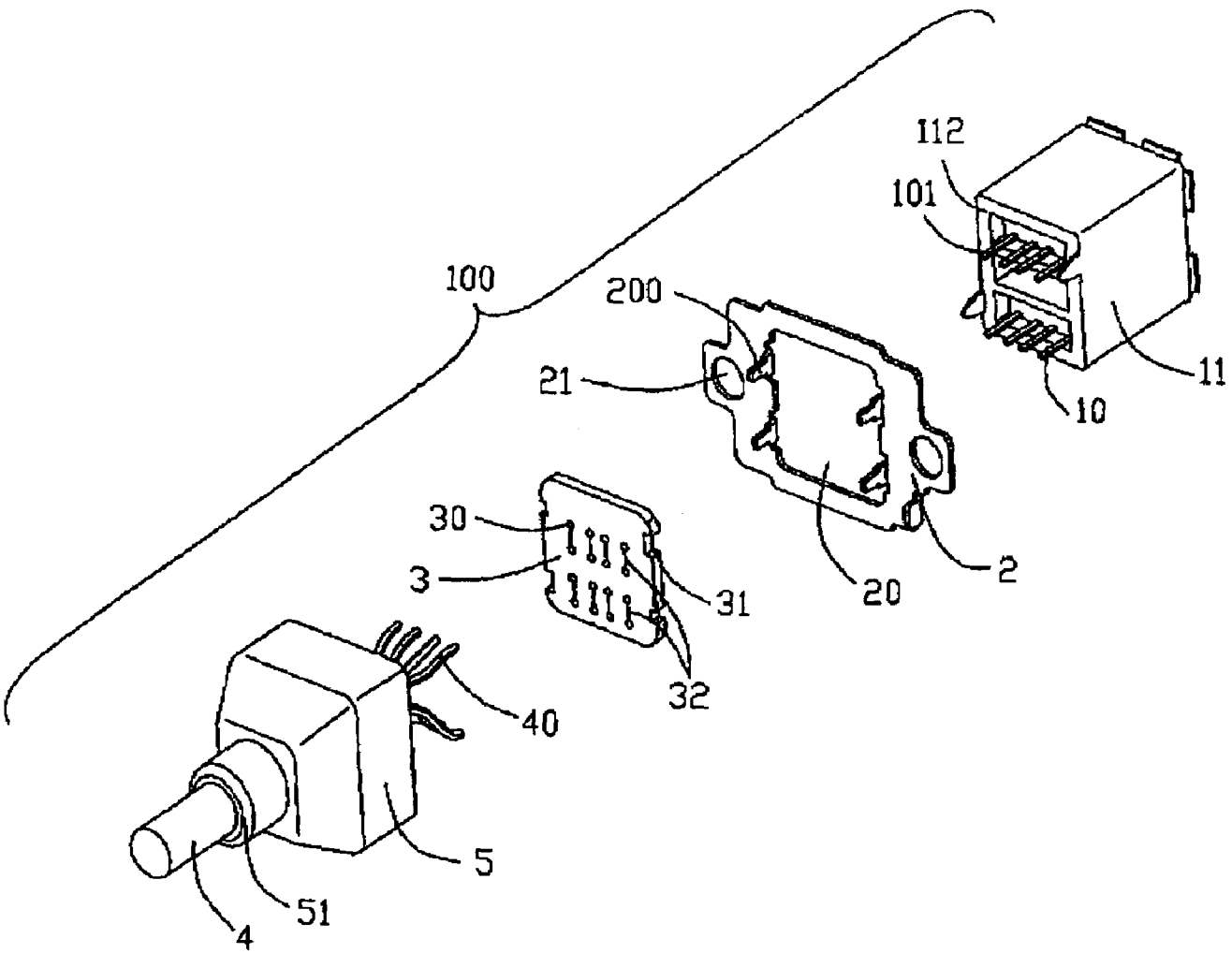
FIG. 4 is an exploded, perspective view of a cable connector assembly of another alternative embodiment which illustrates a different interconnection manner between terminals and wires of a cable.

Referring to FIG. 4, in an alternative manner, the printed circuit board 3 may define four rows of the passageways, two pairs of first passageways are used to electrically receive the tail ends 101 of the terminals 10 therein, two rows of second passageways are used to electrically receive the signal conductors 40 of the cable 4 therein, each tail end 101 of the terminal 10 is electrically attached to corresponding signal conductor 40 of the cable 4 by an electrical trace formed between the first passageways and corresponding second passageways. Or, the printed circuit board comprises a plurality of pads 32 on one surface thereof for electrically connecting with the signal conductors 40 of the cable 4, a plurality of passageways for allowing the terminals 10 to extend through, the pads and passageways establish an electrical connection by means of a set of traces formed between the pads and the passageways. For preventing a loosing problem as discussed above, based on previous way, we also can provide adhesive material therebetween or solder the cable 4 with the passageways. Additionally, the four C-shape holes 31 can electrically connect one another by providing a set of electrical traces therebetween, furthermore, providing another hole electrically connecting with one of the four C-shape holes 31 for allowing the single grounding conductor 41 to be soldered with and establishing a grounding path alternatively. We also can provide another recesses spaced from the C-shape holes 31 for allowing the locking fingers 200 of the frame 2 to restrictedly locate in, and soldering the grounding conductor 41 within either the C-shape holes 31 or the recesses.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly for mating with a mating connector, comprising:

a connector, having a plurality of terminals assembled therein and extending in a first direction, said connector further having a finger formed of conductive material;

a frame attached with the connector, said frame defining a locking finger;

a printed circuit board assembled with the frame and electrically connecting with the terminals, the printed circuit board defining a corresponding recess for allowing the locking finger to be inserted in, and the finger of the connector received in the recess and overlapped with the locking finger;

a cable with a plurality of conductor electrically attaching with the printed circuit board;

wherein the terminals are arranged perpendicularly to the printed circuit board.

2. The cable connector assembly as claimed in claim 1, wherein the printed circuit board defines a plurality of passageways for allowing the terminals to extend through, the terminals are electrically connecting with the conductor of the cable within the passageways of the printed circuit board.

3. The cable connector assembly as claimed in claim 2, wherein the passageways are arranged in four rows, two row of the passageways attach with the terminals, the other two row of the passageways attach with the conductors of the cable, and wherein these two rows of passageways are electrically connecting with the other two rows of passageways by electrical traces as to electrically connect the terminals with the conductors of the cable.

4. The cable connector assembly as claimed in claim 1, wherein the conductors of the cable comprises a plurality of signal conductors for electrically attaching with the terminals, and at least a single grounding conductor electrically attaching with one of the finger and the locking finger.

5. The cable connector assembly as claimed in claim 4, wherein the recess is provided with conductive material for making the electrically and mechanical connection among the finger of the connector, the locking finger of the frame and the grounding conductor of the cable reliably.

6. The cable connector assembly as claimed in claim 1, wherein the frame defines a locking finger, and the printed circuit board defines a corresponding C-shape hole for allowing the locking finger to be located in.

7. The cable connector assembly as claimed in claim 6, wherein the connector comprises a finger formed of conductive material, the locking finger formed of conductive material, the finger and the locking finger overlapped with each other are located in the C-shape hole.

8. The cable connector assembly as claimed in claim 1, wherein the cable comprises a plurality of signal conductors electrically attached with the terminals, and at least a single grounding conductor electrically attaching with one of the frame and the connector.

9. The cable connector assembly as claimed in claim 8, wherein the connector comprises a finger formed of a conductive material, the finger is electrically connecting with the grounding conductor of the cable for establishing a grounding path.

10. The cable connector assembly as claimed in claim 1, wherein the cable connector assembly further comprises a cover attached to the frame by means of one of providing an adhesive material and providing locking means therebetween for receiving the printed circuit board therein.

11. A cable connector assembly for mating with a mating connector, comprising:

a connector defining a plurality of terminals received therein, and a finger formed of a conductive material extending beyond a surface thereof;

a printed circuit board defining a plurality of passageways for allowing the terminals to extending through, and a hole for allowing the finger to insert therein; and a cable defining a plurality of signal conductors electrically attached with the terminals through the passageways, and at least a grounding conductor electrically attached with the finger through the hole; a frame arranged between the connector and the printed circuit board, said frame defining locking finger received in the hole and arranged side by side with the finger of the connector, and electrically attached with one of the finger of the connector and the grounding conductor of the cable.

12. The cable connector assembly as claimed in claim 11, wherein the cable connector assembly further comprises a cover attached with the frame for receiving the printed circuit board therebetween.

* * * * *